US011896867B1

(12) United States Patent
Nolan et al.

(10) Patent No.: US 11,896,867 B1
(45) Date of Patent: Feb. 13, 2024

(54) TROLLEY SYSTEM FOR ENGAGING WITH A POST OF A SELECTED EXERCISE MACHINE

(71) Applicant: Bulletproof Fitness Equipment Inc, Acton, CA (US)

(72) Inventors: Lawrence R. Nolan, Santa Clarita, CA (US); Nicole K. Nolan, Santa Clarita, CA (US); Christopher I. Gaddy, Brooklyn, NY (US)

( * ) Notice: Subject to any disclaimer, the term of this patent is extended or adjusted under 35 U.S.C. 154(b) by 0 days.

(21) Appl. No.: 18/334,033

(22) Filed: Jun. 13, 2023

Related U.S. Application Data

(63) Continuation-in-part of application No. 17/677,278, filed on Feb. 22, 2022, which is a continuation-in-part of application No. 17/034,950, filed on Sep. 28, 2020, now Pat. No. 11,517,785.

(60) Provisional application No. 63/420,229, filed on Oct. 28, 2022, provisional application No. 63/411,313, filed on Sep. 29, 2022.

(51) Int. Cl.

| | |
|---|---|
| ***A63B 21/00*** | (2006.01) |
| ***A63B 21/068*** | (2006.01) |
| *A63B 1/00* | (2006.01) |
| *A63B 17/04* | (2006.01) |

(52) U.S. Cl.
CPC ..... *A63B 21/4027* (2015.10); *A63B 1/00* (2013.01); *A63B 17/04* (2013.01); *A63B 21/068* (2013.01); *A63B 21/156* (2013.01); *A63B 21/4035* (2015.10); *A63B 2225/09* (2013.01)

(58) Field of Classification Search
CPC ..... A63B 21/156; A63B 21/4035; A63B 21/4047; A63B 21/00058; A63B 21/00061; A63B 21/00065; A63B 21/068; A63B 21/4027; A63B 1/00; A63B 17/04; A61F 5/055
See application file for complete search history.

(56) References Cited

U.S. PATENT DOCUMENTS

| | | | |
|---|---|---|---|
| 5,788,614 | A | 8/1998 | Simonson |
| 6,238,323 | B1 | 5/2001 | Simonson |
| 6,302,833 | B1 | 10/2001 | Ellis et al. |
| 6,488,612 | B2 | 12/2002 | Sechrest et al. |
| 6,905,446 | B2 | 6/2005 | Greenland |
| 7,455,621 | B1 | 11/2008 | Anthony |
| 7,918,771 | B2 | 4/2011 | Rogers et al. |
| 11,013,945 | B2 | 5/2021 | Sorin et al. |

(Continued)

FOREIGN PATENT DOCUMENTS

| | | | |
|---|---|---|---|
| WO | 2019199352 | A1 | 10/2019 |
| WO | 2023163728 | A1 | 8/2023 |

OTHER PUBLICATIONS

International Search Report, dated Jul. 12, 2022, issued in International Patent Application PCT/2022/023315, 1 page.

*Primary Examiner* — Megan Anderson
(74) *Attorney, Agent, or Firm* — Avek IP, LLC

(57) ABSTRACT

An adjustable exercise equipment system includes a post as part of an exercise machine; a trolley system for engagement with the post, the trolley system having a body forming a channel to receive the post; rollers supported by the body and to provide movement of the body along the post; and a receiver supported by the body, the receiver to engage with a user engageable device; the body and the of rollers allow for selective movement along the post as a user interacts with the user engageable device.

17 Claims, 12 Drawing Sheets

(56) References Cited

U.S. PATENT DOCUMENTS

| | | | | |
|---|---|---|---|---|
| 11,173,337 | B2 * | 11/2021 | Jones | A63B 21/0615 |
| 2007/0203002 | A1 | 8/2007 | Webber | |
| 2010/0152001 | A1 | 6/2010 | Gordon | |
| 2013/0184128 | A1 | 7/2013 | Towley, III et al. | |
| 2017/0056707 | A1 | 3/2017 | Hockridge et al. | |
| 2019/0269963 | A1 | 9/2019 | Steenekamp et al. | |

* cited by examiner

TROLLEY SYSTEM FOR ENGAGING WITH A POST OF A SELECTED EXERCISE MACHINE

RELATED APPLICATIONS

This application is a continuation-in-part of U.S. patent application Ser. No. 17/677,278, filed Feb. 22, 2022, which is a continuation-in-part of U.S. patent application No. Ser. 17/034,950, filed Sep. 28, 2020, which granted as U.S. Pat. No. 11,517,785. U.S. patent application Ser. No. 17/955,302, filed Sep. 28, 2022, is also a continuation-in-part of U.S. patent application Ser. No. 17/034,950, filed Sep. 28, 2020. This application claims priority to U.S. Provisional Application No. 63/411,313, filed Sep. 29, 2022, and U.S. Provisional Application No. 63/420,229, filed Oct. 28, 2022. The disclosures of each of these applications are incorporated by reference in their entireties herein.

FIELD OF INVENTION

The disclosure relates generally to exercise equipment. More specifically, the disclosure relates to a trolley system for engagement with a post such that the trolley system allows for selective adjustment along the post and provides for attachment to one or more user engageable devices to the trolley system.

SUMMARY

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the invention will be apparent from the following detailed description of the embodiments and the accompanying drawing figures.

According to an embodiment of the current disclosure, the invention includes a trolley system for engagement with a post as part of an exercise machine, the trolley system comprising a body forming a channel, the channel to receive the post; a plurality of rollers supported by the body and configured to provide movement of the body along the post; and a receiver supported by the body, the receiver configured to engage with a user engageable device; wherein the body and the plurality of rollers allow for selective movement along the post as a user interacts with the user engageable device.

In other aspects of the present disclosure, the invention includes an adjustable exercise equipment system, comprising a post, and a trolley system for engagement with the post, the trolley system having a body forming a channel to receive the post; a plurality of rollers supported by the body and configured to provide movement of the body along the post; and a receiver supported by the body, the receiver configured to engage with a user engageable device; wherein the body and the plurality of rollers allow for movement along the post as a user interacts with the user engageable device.

BRIEF DESCRIPTION OF THE DRAWINGS

Embodiments of the invention are described in detail below with reference to the attached drawings.

The drawings do not limit the invention to the specific embodiments disclosed and described herein. The drawings are not necessarily to scale, emphasis instead being placed upon clearly illustrating various principles of the disclosure.

DETAILED DESCRIPTION

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments but is not necessarily included. Thus, the technology can include a variety of combinations and/or integrations of the embodiments described herein.

Exercise equipment is well known in the art and varies from complex machinery to simple devices, wherein a user may select various equipment based on their needs. Those skilled in the art will recognize that adjustability in exercise equipment is desirable. For example, a user may desire to add or remove components from equipment based on a movement they desire to perform. As another example, a user may need to adjust the height or other location of equipment components based on their own physical needs. Accordingly, the present invention provides for a trolley system and one or more associated exercise equipment systems, wherein the trolley is specifically configured to selectively move along a post of the exercise equipment. The trolley can include various receivers to engage with user engageable devices, such as barbells, handles, pads, platforms, or the like. In addition, the trolley is adapted to freely move along the post or be locked into a desired position, thereby allowing for a user to make adjustments based on an exercise being performed. And yet further, the trolley may be used with various types of posts, such as vertical posts associated with smith machines, racks, or other similar vertical posts, or for use with arms that may be pivotally engaged with vertical systems. Accordingly, the trolley system of the present invention can be adapted and used in a variety of environments with minor adjustments based on the needs of the user.

Figure 1:
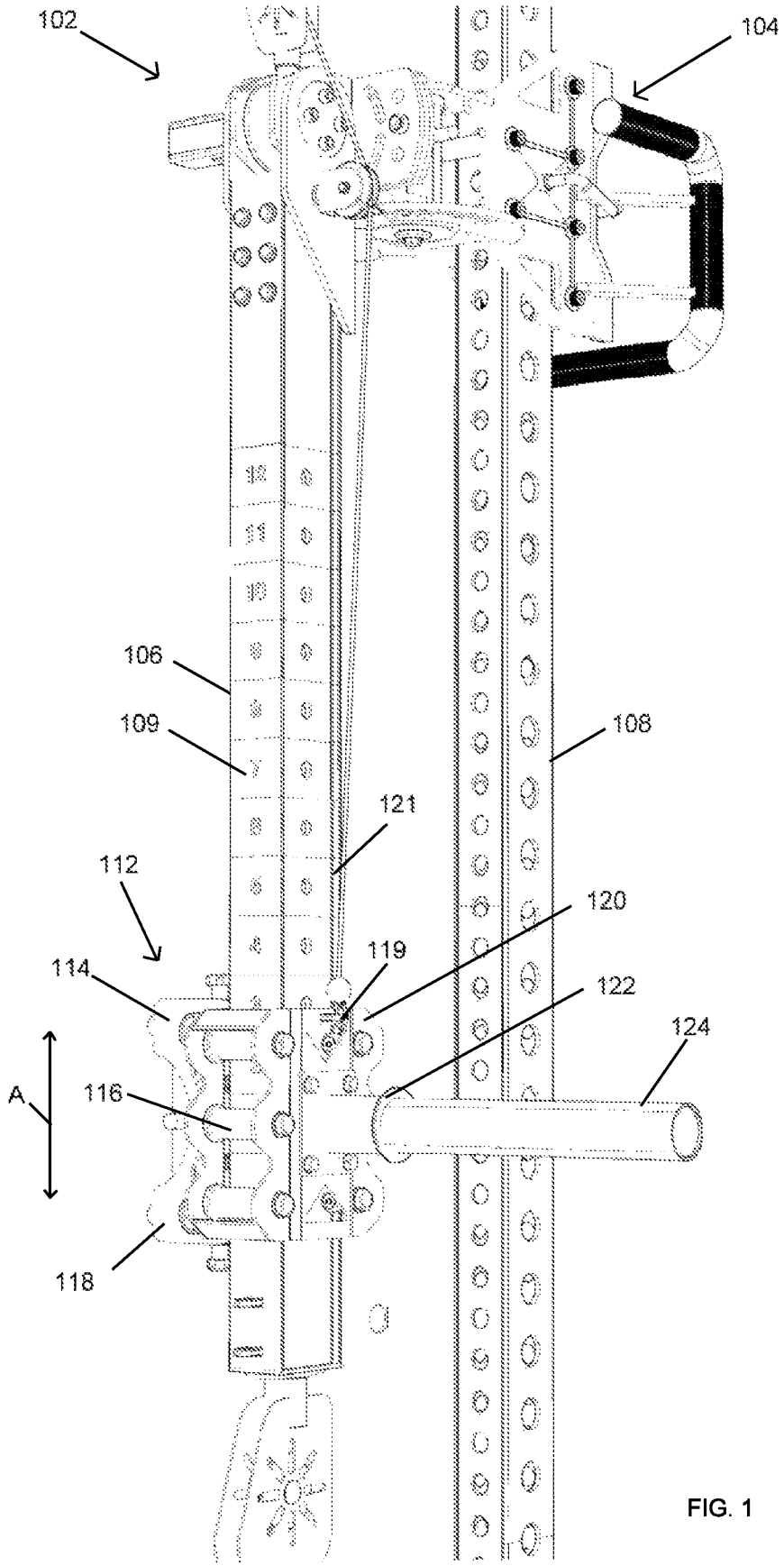
FIG. 1 is a front angled view of an embodiment of an adjustable exercise equipment system with a first embodiment of a trolley system in accordance with the present invention.
Figure 2:
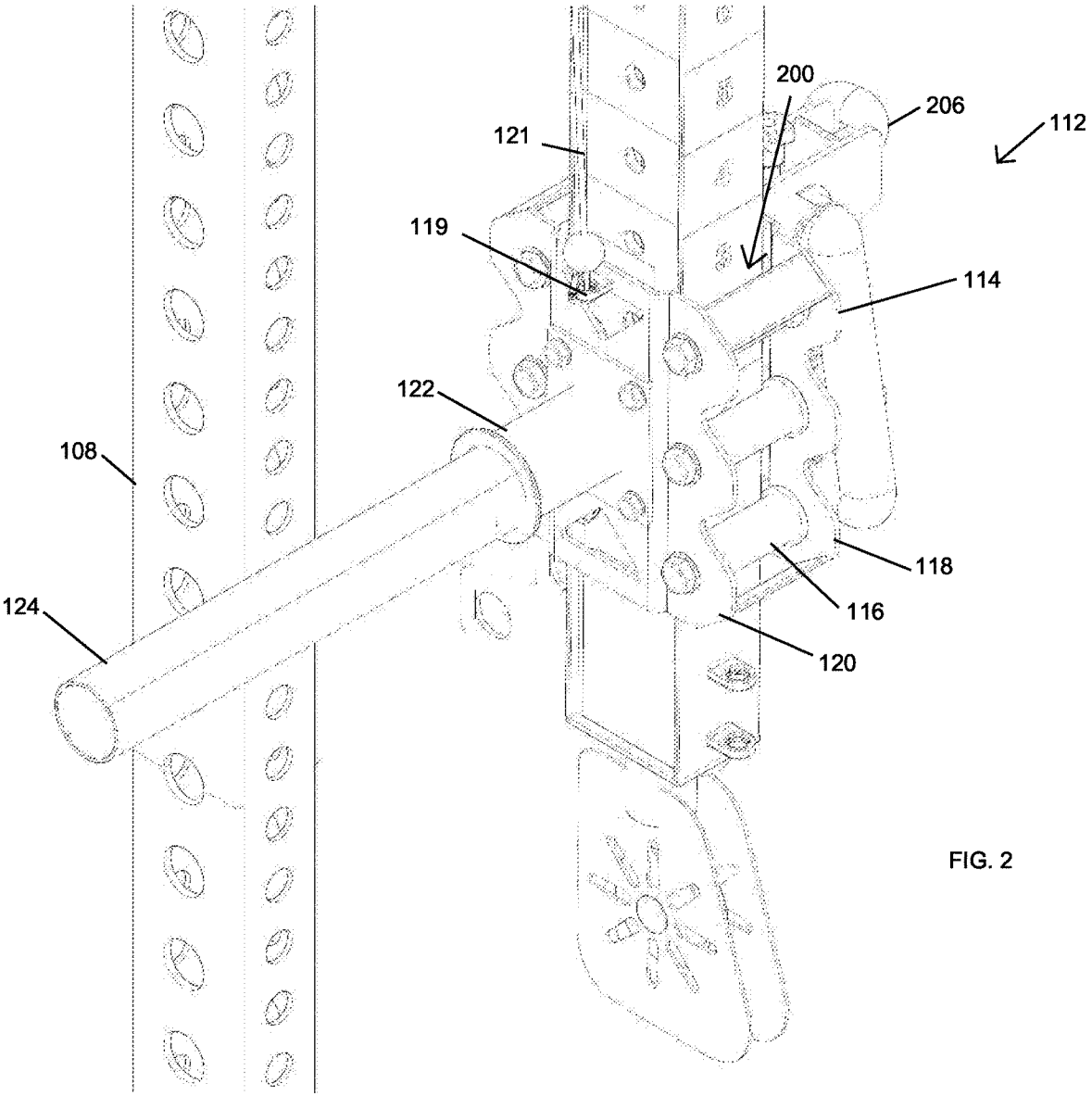
FIG. 2 is a close up, front angled view of the trolley system of FIG. 1.

In FIGS. 1 and 2, a first embodiment of a trolley system 112 is shown. The trolley system 112 in this embodiment is shown engaged with an arm embodiment of a post 106 as part of an overall exercise equipment system 102. The post 106 is engaged with a vertical system 108, such as via a carriage 104 that allows for pivoting of the post 106 thereabout, as well as other adjustments. Those skilled in the art will recognize that the post 106 being in the configuration of an arm may vary, such as in size, and functional use. Further, the vertical system 108 may vary, such as being a standalone vertical system, a smith unit, or any other vertical system.

Trolley system 112 includes a body 114 forming a channel 200 (see FIG. 2), the channel 200 configured to receive the post 106 and provide for movement along the post 106, as shown with arrow A. The body 114 may vary but in embodiments includes a first side 118 and a second side 120 with a plurality of rollers 116 extending between the first side 118 and the second side 120 as part of a front and back portion of the body 114. In other words, the plurality of rollers 116 engage with a surfaces (example surface 109) of the post 106 to provide vertical adjustment of the trolley system 112 along the post. As shown, in embodiments, the rollers 116 are open, however, other embodiments may include covers over the rollers to prevent access, such as to improve safety.

The trolley system 112 further includes a receiver 122 configured to receive one or more user engageable devices 124. In the example shown, the receiver 122 is tubal in nature and configured to receive a bar or similar apparatus. This may provide for attachment of a handle, a bar, one or more pads, a platform, or a variety of other user engageable devices 124. This allows for a user to select how they utilize the trolley system 112. In embodiments, the receiver 112 may be bolted or otherwise secured directly to one of the sides 120. In addition, some embodiments may include a cable attachment 119 for engagement with a cable 121, again providing a user with alternative uses of the trolley system.

FIG. 2 depicts a mirror image of FIG. 1, further showing trolley system 112 which may further include one or more handles 206 extending from the body 114 for user manipulation of the trolley system 112. Those skilled in the art will appreciate that the handle 206 may vary.

Those skilled in the art will appreciate that the trolley system 112 is unique and can be adapted and used with various posts to provide for attachment of one or more user engageable devices. The rollers 116 allow for the trolley system 112 to glide along the post 106, accordingly, although trolley system 112 is shown with three rollers on either side, additional or fewer rollers may be used.

In FIGS. 3-8 an alternative embodiment of a trolley system 300 is shown. The features discussed for each embodiment, namely trolley system 300 and trolley system 112 may be interchanged as desired.

Figure 3:
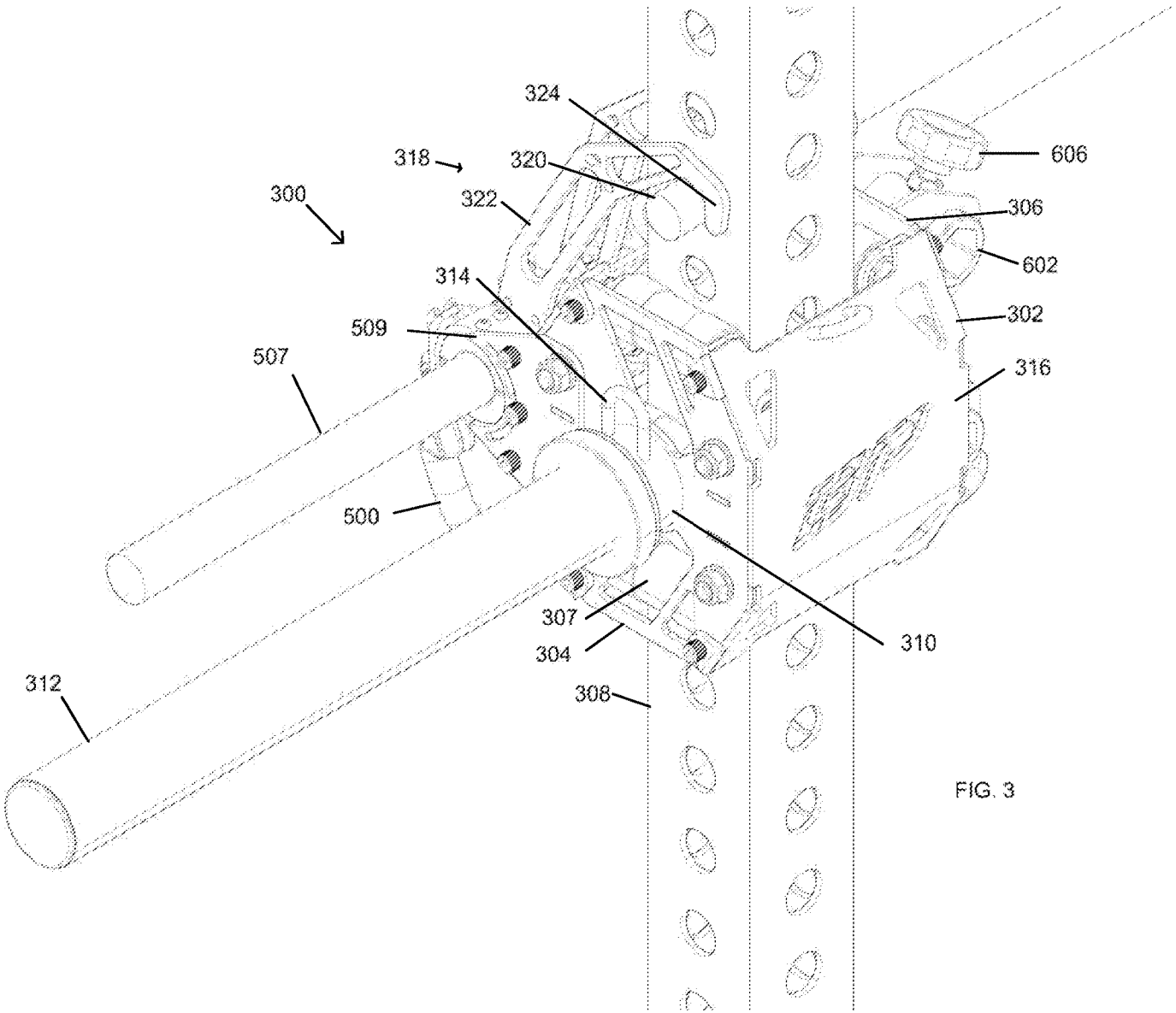
FIG. 3 is a front angled view of a second embodiment of a trolley for use with an adjustable exercise equipment system in accordance with the present invention.
Figure 4:
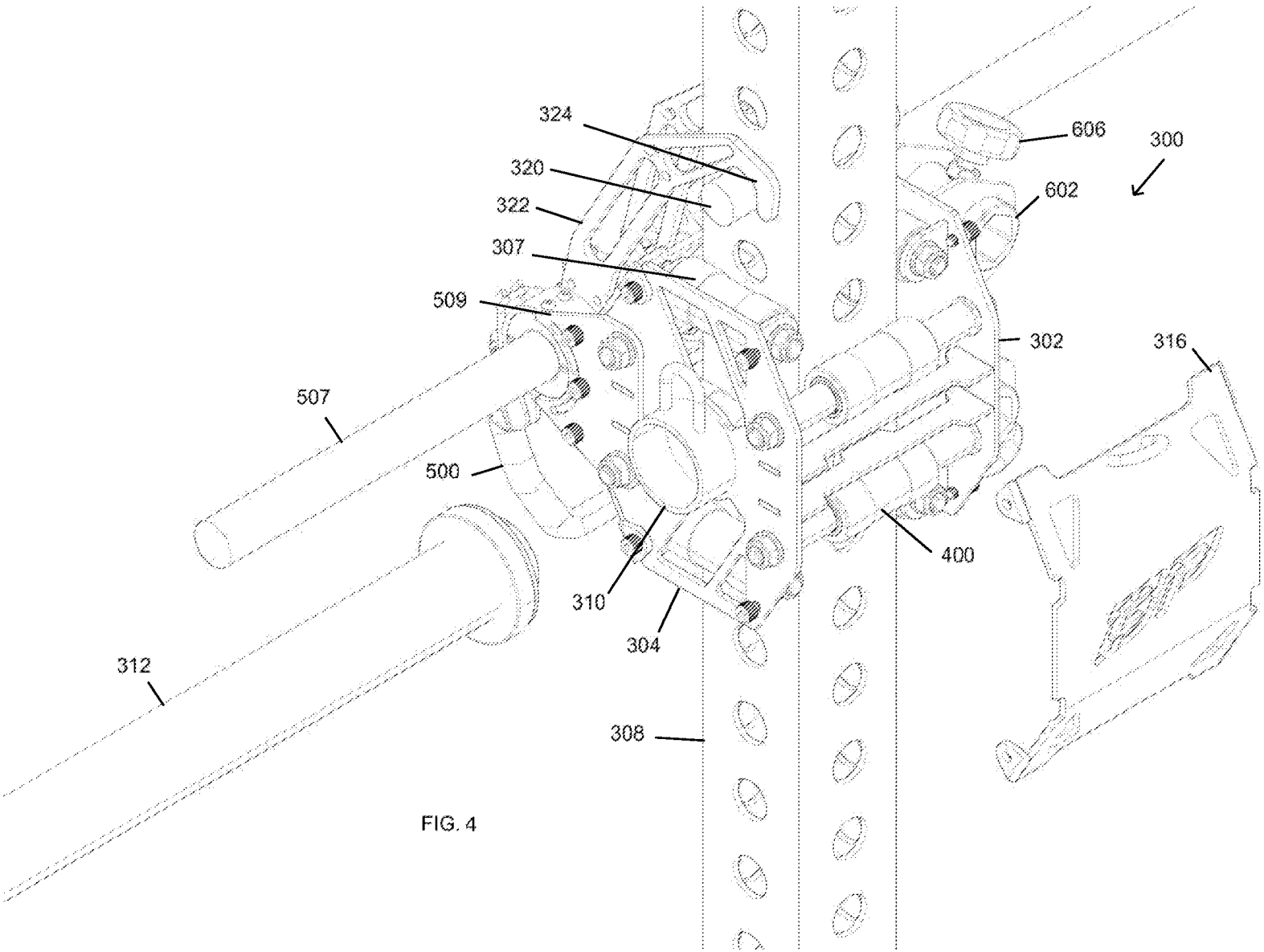
FIG. 4 is an exploded, front angled view of the trolley system of FIG. 3.

In FIGS. 3 and 4, the trolley system 300 is shown from a first angle in constructed and disassembled forms respectively. Trolley system 300 includes a body 302 with a first side 304 and a second side 306 with a plurality of rollers 307, 400 extending therebetween. The rollers 307, 400 engage with a post 308 to provide vertical movement and adjustability of the trolley system 300 along the post 308. As best shown in FIG. 4, trolley system 300 may include rollers positioned along each side of the post 308, namely on all four sides of the post, as opposed to two sides, however, embodiments may utilize merely two sides of rollers. Again, those skilled in the art will appreciate that the post 308 can vary and can be manufactured specifically for use with the trolley system 300 or can be a known and previously designed and manufactured part of an exercise machine, such as a smith machine.

Trolley system 300 further includes a receiver 310, which in embodiments is tubular and configured to receive a user engageable device 312, such as a bar, handle, or other device. A pin 314 or similar apparatus may be used to extend through the receiver 310 to secure the user engageable device 312 therein.

In embodiments, a cover 316 attaches to the first side 304 and second side 306 to at least partially cover the rollers 307, 400. This may improve aesthetics and safety of the trolley system 300. The cover may be secured through any means known in the art, such as bolts, screws, pins, etc.

Further, in embodiments, a locking system 318 is used to lock the trolley system 300 at a desired position along the post 308. The locking system 318 includes a pin 320 extending through one or more apertures of the post 308 and a clamp 322 with one or more hooks 324 to engage with the pin 320 and/or one or more apertures (see FIG. 5) to lock the body 302 of the trolley system 300. The clamp 322 and hook 324, in embodiments, are an integral unit, however, alternative embodiments contemplate separate components.

Figure 5:
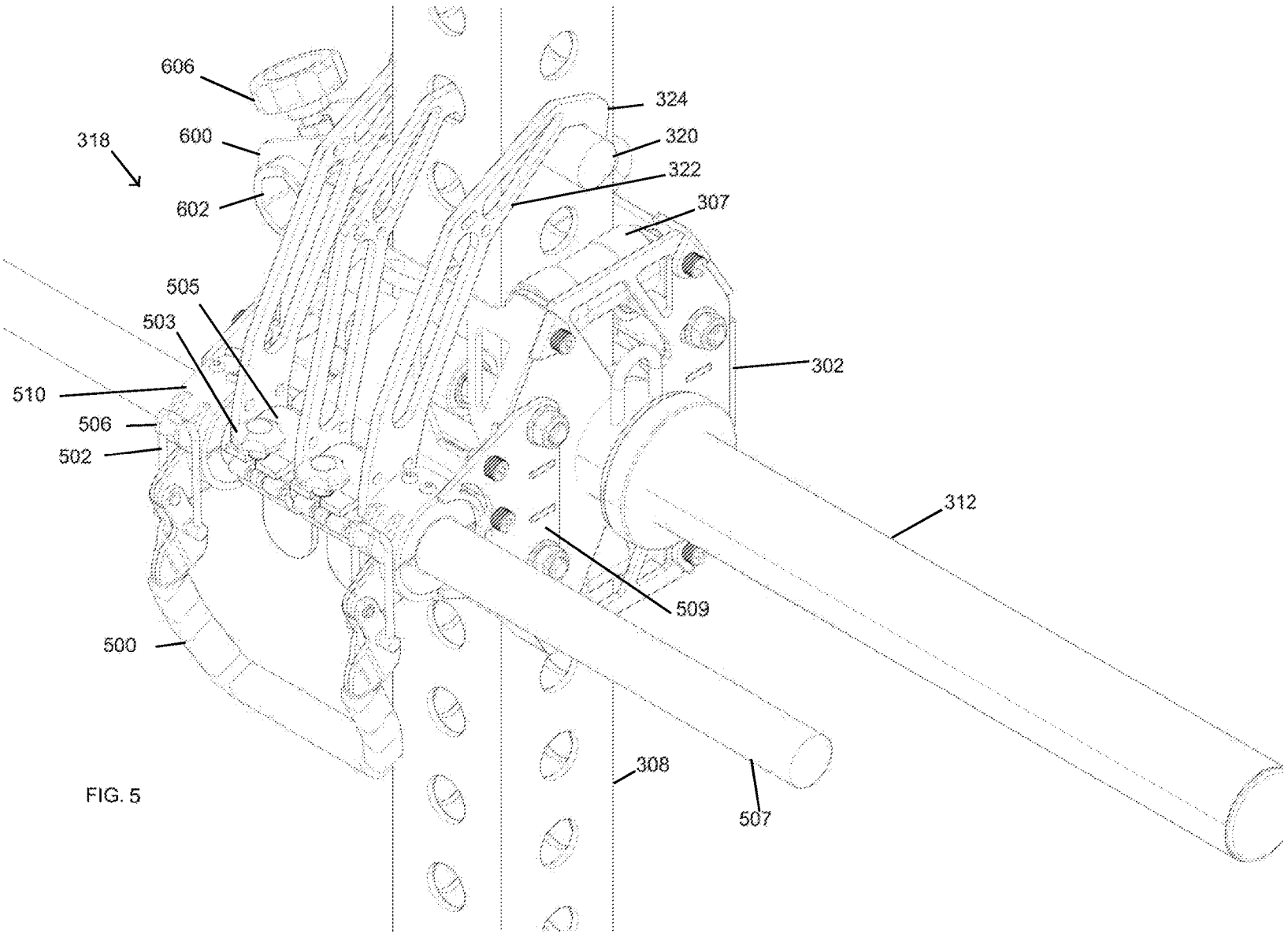
FIG. 5 is a back angled view of the trolley system of FIG. 3.
Figure 8:
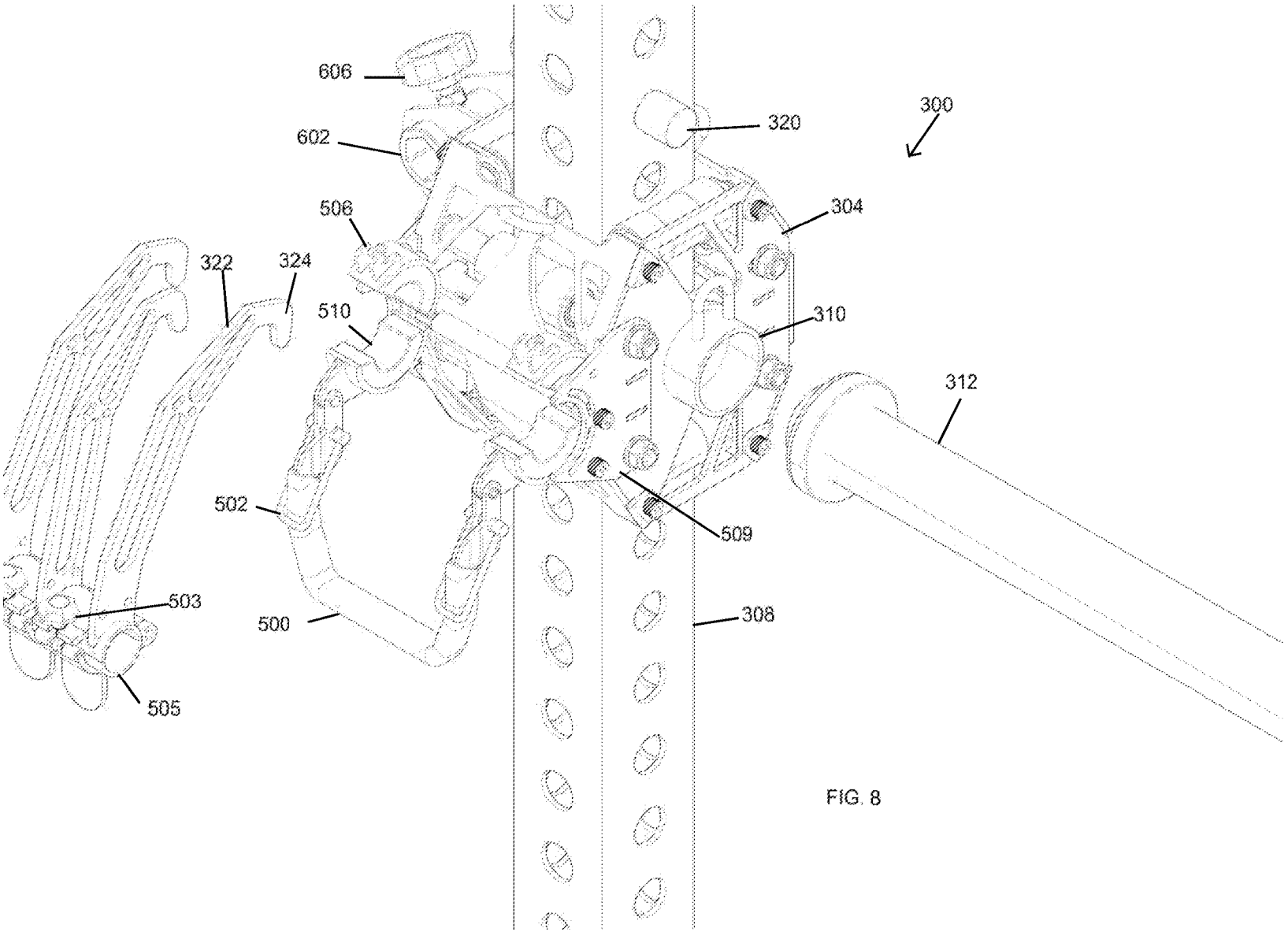
FIG. 8 is an angled view showing a locking system of the trolley system of FIGS. 3-7 in a disassembled configuration.
Figure 9:
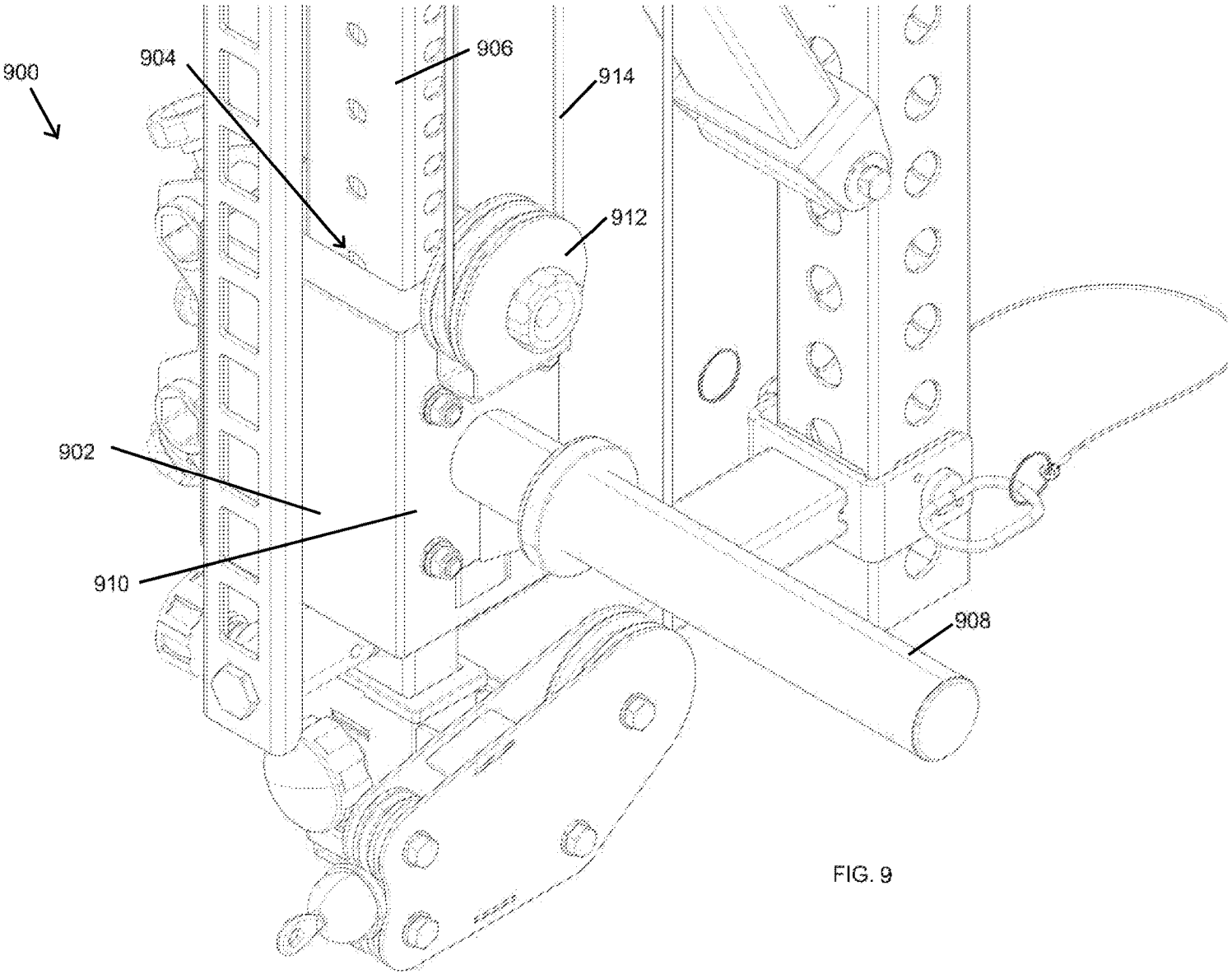
FIG. 9 is a front angled view of a third embodiment of a trolley system for use with an adjustable exercise equipment system in accordance with the present invention.

As best shown in FIGS. 5 and 8, the clamp 322 is connected to a support 505 through which a bar 507 may extend therethrough. The support 505 is configured to tighten onto the bar 507 via one or more rotationally engaged knobs 503. In other words, the bar 507 extends through the support(s) 505 and the clamp 322 and support(s) 505 are then tightened onto the bar 507 via knob(s) 503.

A handle 500 is mechanically coupled to the body 302 such as via one or more side braces 509. The handle 500 is further engaged with tubular clamps 510, such that the bar 507 extends through the tubular clamps 510, which can then be closed around the bar 507 and locked in place by one or more clips 502 and hook elements 506. In other words, the user will utilize the handle 500 to clamp around the bar 507 and lock the assembly in place via the clip(s) 502 and hook(s) 506. Accordingly, the entire locking system 318 can then lock into place.

Figure 6:
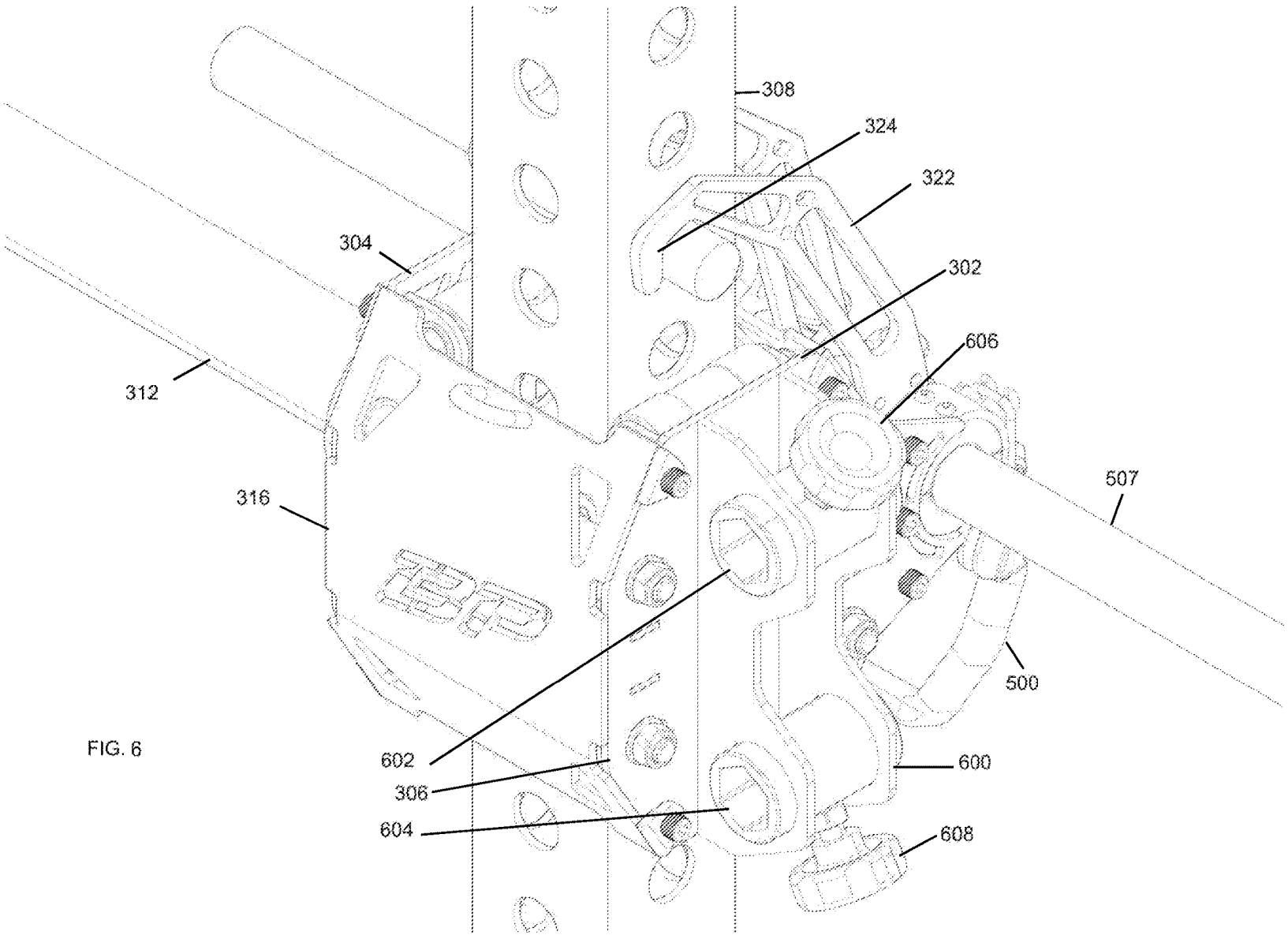
FIG. 6 is another front angled view of the trolley system of FIG. 3.
Figure 7:
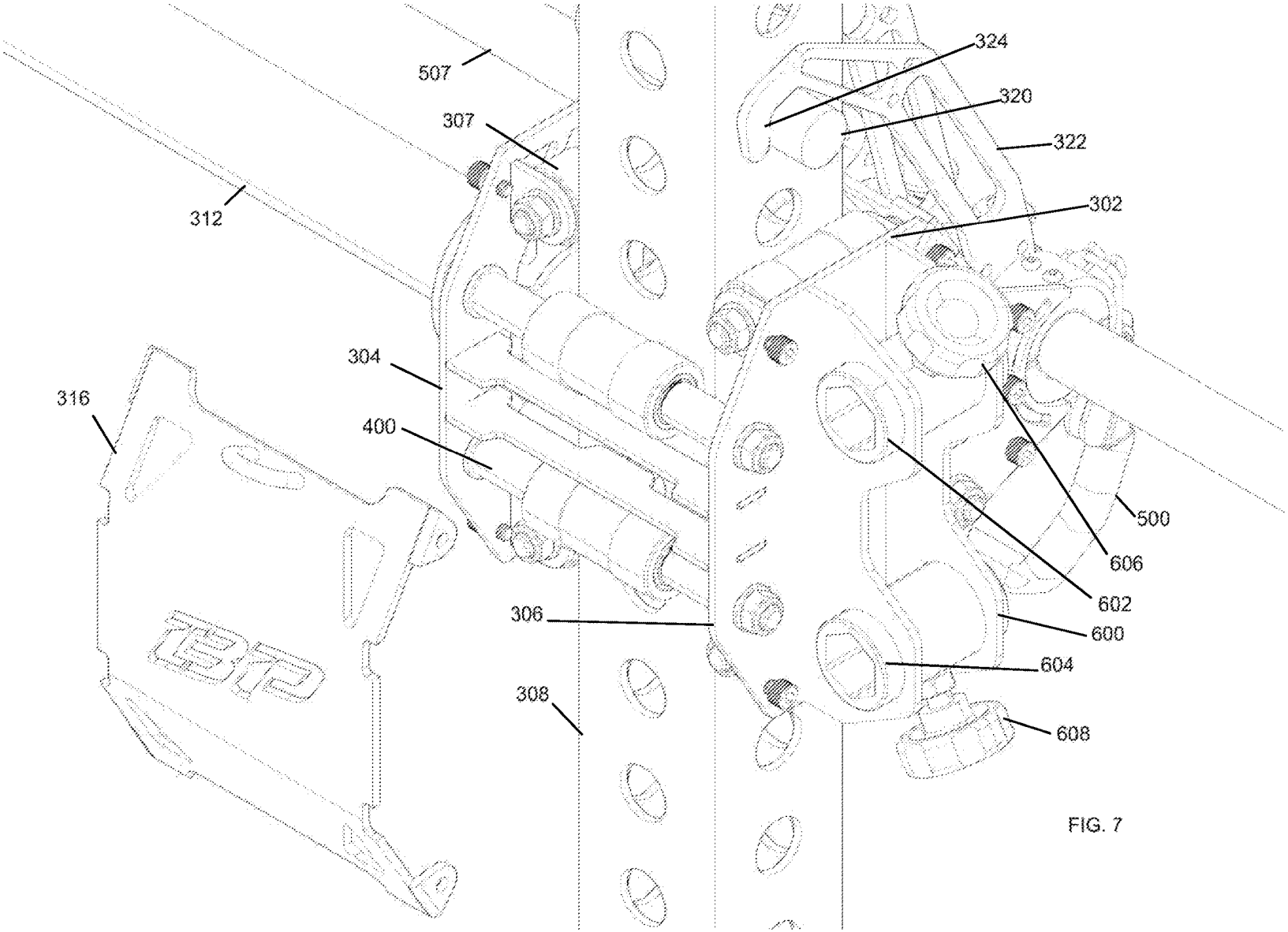
FIG. 7 is another exploded front angled view of the trolley system of FIG. 3.

In FIGS. 6 and 7, trolley system 300 is also shown from a second angle. In embodiments, trolley system 300 includes a secondary attachment receiver 600 extending from the body 302 and having one or more ports 602, 604 to receive one or more secondary user engageable devices. These ports 602, 604 can be configured in hexagonal shapes to allow for attachment of devices at various angles with corresponding connections. Rotational locking bolts 606, 608 can be provided to lock into the ports 602, 604.

In FIGS. 9 through 12 a third embodiment of a trolley system 900 is shown. Trolley system 900 includes a body 902 forming a channel 904 configured to receive a post 906 therethrough, such that the trolley 900 can travel along the post 906. One or more handles 908 may extend from a side 910 of the body 902 for user engagement. The handle(s) 908 may vary, or in alternative embodiments, may be replaced by a bar or other user engageable attachment. The body 902 houses a plurality of rollers (not shown) similar to the other embodiments discussed above. The plurality of rollers providing for movement along the post 906.

Trolley system 900, in embodiments, further includes one or more cable attachments 912 such that a cable 914 may be coupled to the trolley 900 and therefore provide cable assisted or weighted movements for the trolley 900. The cable attachment(s) 912 may be mounted to the trolley 900 via any means known in the art. For example, as shown best in FIG. 11, a bracket 1100 and bolt 1101 system may be used to secure the cable thereon.

Figure 10:
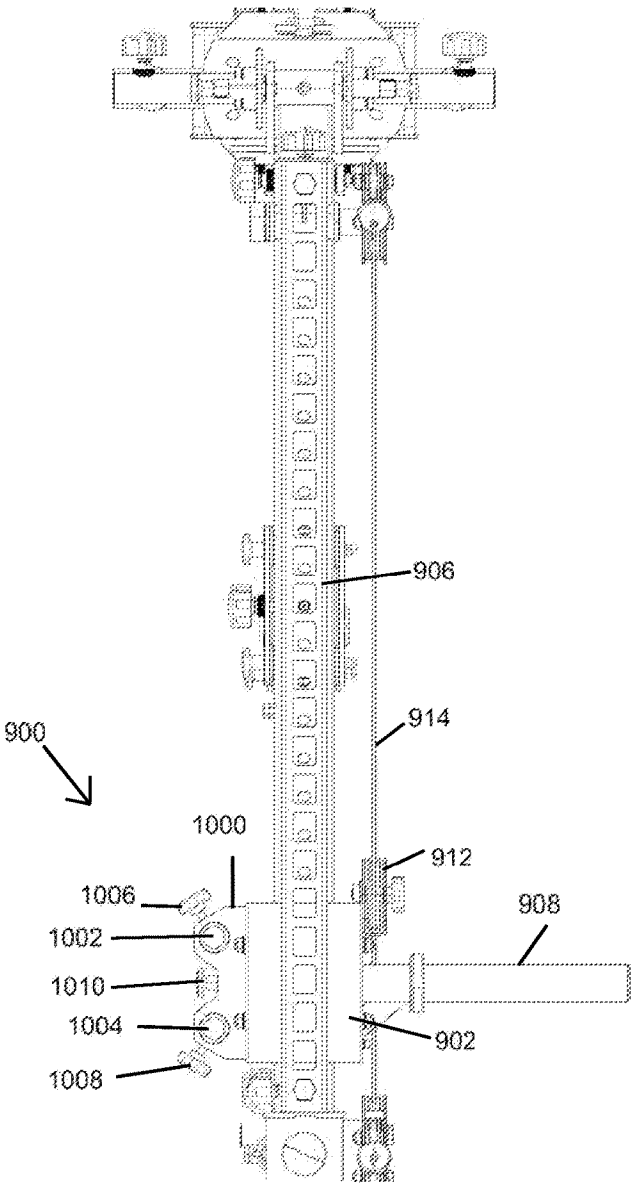
FIG. 10 is a front view of the trolley system of FIG. 9.
Figure 11:
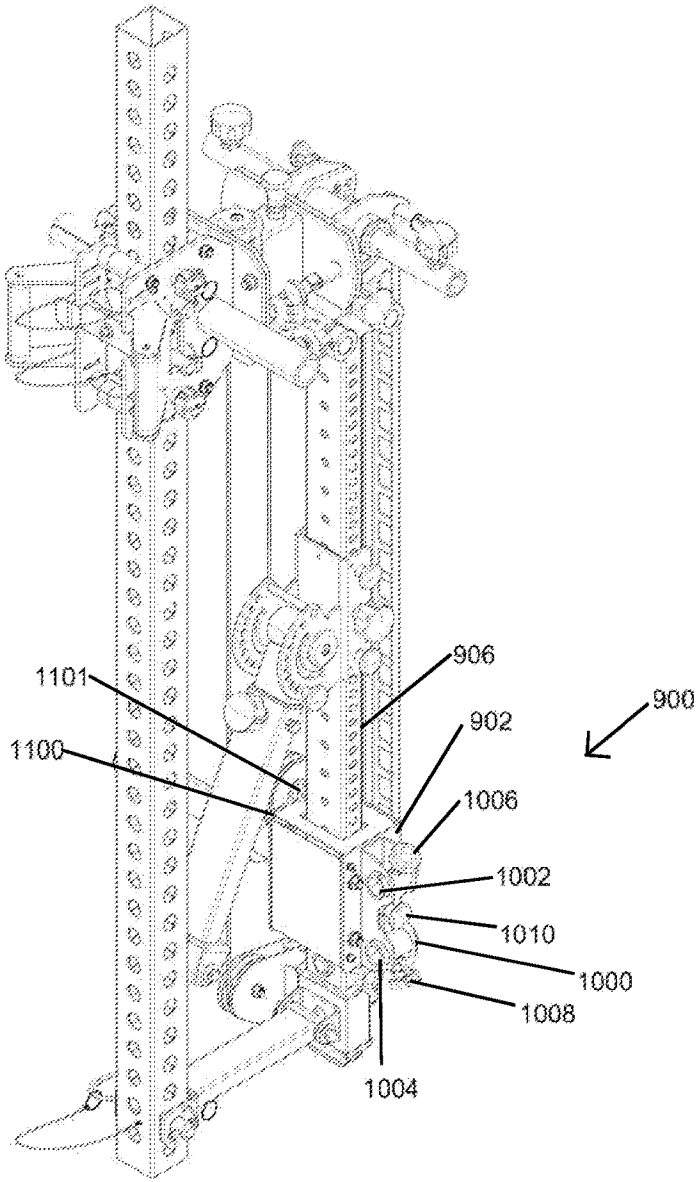
FIG. 11 is a rear angled view of the trolley system of FIG. 9.
Figure 12:
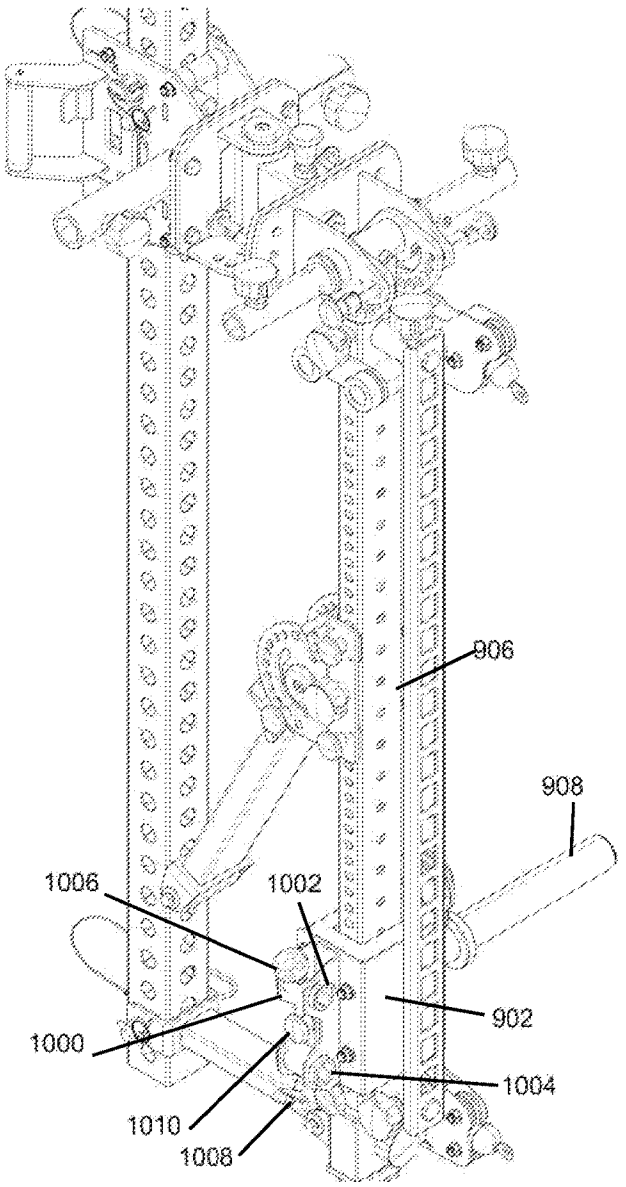
FIG. 12 is a front angled view of the trolley system of FIG. 9.

As best shown in FIGS. 10, 11, and 12, the trolley 900, in embodiments, includes a secondary attachment receiver 1000 extending from the body 902 and having one or more ports 1002, 1004 to receive one or more secondary user engageable devices. These ports 1002, 1004 can be configured in hexagonal shapes to allow for attachment of devices at various angles with corresponding connections. In embodiments, the ports 1002, 1004 extend through the secondary attachment receiver 1000 from a first side to a second side, thereby providing dual openings for receiving attachments. Rotational locking bolts 1006, 1008 can be provided to lock into the ports 1002, 1004. In embodiments, a knob 1010 extends from the secondary attachment receiver 1000 and could be used as a handle or another point of attachment of an accessory.

Many different arrangements of the various components depicted, as well as components not shown, are possible without departing from the spirit and scope of the present disclosure. Embodiments of the present disclosure have been described with the intent to be illustrative rather than restrictive. Alternative embodiments will become apparent to those skilled in the art that do not depart from its scope. A skilled artisan may develop alternative means of implementing the aforementioned improvements without departing from the scope of the present disclosure. It will be understood that certain features and subcombinations are of utility and may be employed without reference to other features and subcombinations. Not all steps listed in the various figures need be carried out in the specific order described.

What is claimed is:

1. A trolley system for engagement with a post of a selected exercise machine, the trolley system comprising:

a body forming a channel, the channel to receive the post therethrough;

a plurality of rollers supported by the body and configured to provide movement of the body along the post;

a receiver supported by the body, the receiver configured to engage with a user engageable device; and a locking system configured to lock the body at a position along the post, the locking system having a pin to extend through one or more apertures along the post and a clamp attached to the body and having one or more hooks to engage with the pin such that body is releasably locked to the pin;

wherein the body and the plurality of rollers selectively allow for movement along the post as a user interacts with the user engageable device.

2. The trolley system of claim 1, wherein the plurality of rollers comprises:

a first plurality of rollers extending along a first portion of the body; and a second plurality of rollers extending along a second portion of the body;

wherein the first plurality of rollers are configured to roll along a first surface of the post;

wherein the second plurality of rollers are configured to roll along a second surface of the post.

3. The trolley system of claim 2, wherein the body further comprises:

a first side and a second side;

wherein the first plurality of rollers extend between the first side and the second side;

wherein the second plurality of rollers extend between the first side and the second side; and wherein the channel is formed between the first side, the second side, the first plurality of rollers, and the second plurality of rollers.

4. The trolley system of claim 1, further comprising:

a secondary attachment receiver extending from the body and having one or more ports to receive one or more secondary user engageable devices.

5. The trolley system of claim 4, wherein the secondary attachment receiver further comprises:

one or more locking bolts rotatably engaged with the one or more ports to provide securement of the one or more secondary user engageable devices therein.

6. The trolley system of claim 1, wherein the receiver further comprises:

a tubular opening to engage with a bar;

wherein the bar is a part of the user engageable device.

7. The trolley system of claim 1, wherein the locking system further comprises:

a locking handle pivotally operable with the clamp such that the locking handle is configured to apply torque to the clamp to lock the clamp with the pin.

8. An adjustable exercise equipment system, comprising:

a post;

a trolley system for engagement with the post, the trolley system having:

a body forming a channel to receive the post;

a plurality of rollers supported by the body and configured to provide movement of the body along the post;

a receiver supported by the body, the receiver configured to engage with a user engageable device;

a locking system configured to lock the body at a position along the post, the locking system having a pin to extend through one or more holes along the post and a clamp attached to the body and having one or more hooks to engage with the pin such that body is locked to the pin;

wherein the body and the plurality of rollers allow for selective movement along the post as a user interacts with the user engageable device.

9. The system of claim 8, wherein the trolley system further comprising:

a secondary attachment receiver extending from the body and having one or more ports to receive one or more secondary user engageable devices.

10. The system of claim 9, wherein the secondary attachment receiver further comprises:

one or more locking bolts rotatably engaged with the one or more ports to provide securement of the one or more secondary user engageable devices therein.

11. The system of claim 8, wherein the post is a vertical post.

12. The system of claim 8, wherein the plurality of rollers comprises:

a first plurality of rollers extending along a first portion of the body; and a second plurality of rollers extending along a second portion of the body;

wherein the first plurality of rollers are configured to roll along a first surface of the post;

wherein the second plurality of rollers are configured to roll along a second surface of the post.

13. The system of claim 8, wherein the receiver further comprises:

a tubular opening to engage with a bar;

wherein the bar is part of the user engageable device.

14. The system of claim 8, wherein the locking system further comprises:

a locking handle pivotally operable with the clamp such that the locking handle is configured to apply torque to the clamp to lock the clamp with the pin.

15. A trolley system for engagement with a post of a selected exercise machine, the trolley system comprising:

a body forming a channel, the channel to receive the post therethrough;

a plurality of rollers supported by the body and configured to provide movement of the body along the post;

a receiver supported by the body, the receiver configured to engage with a user engageable device; and a locking system configured to lock the body at a position along the post, the locking system having a clamp coupled to the body and having one or more hooks to engage with the post such that body is releasably locked to the post;

wherein the body and the plurality of rollers selectively allow for movement along the post as a user interacts with the user engageable device.

16. The trolley system of claim 15, wherein the locking system further comprises a locking handle pivotally operable with the clamp such that the locking handle is configured to apply torque to the clamp to lock the clamp with the post.

17. The trolley system of claim 15, wherein the one or more hooks engages with an aperture of the post to releasably lock the body to the post.

* * * * *